US011830449B2

(12) United States Patent
Lin

(10) Patent No.: US 11,830,449 B2
(45) Date of Patent: Nov. 28, 2023

(54) ELECTRO-OPTIC DISPLAYS

(71) Applicant: E INK CORPORATION, Billerica, MA (US)

(72) Inventor: Craig Lin, Fremont, CA (US)

(73) Assignee: E INK CORPORATION, Billerica, MA (US)

( * ) Notice: Subject to any disclaimer, the term of this patent is extended or adjusted under 35 U.S.C. 154(b) by 0 days.

(21) Appl. No.: 18/176,449

(22) Filed: Feb. 28, 2023

(65) Prior Publication Data

US 2023/0282176 A1 Sep. 7, 2023

Related U.S. Application Data

(60) Provisional application No. 63/315,265, filed on Mar. 1, 2022.

(51) Int. Cl.
*G09G 3/34* (2006.01)

(52) U.S. Cl.
CPC ..... *G09G 3/344* (2013.01); *G09G 2310/0264* (2013.01); *G09G 2310/06* (2013.01); *G09G 2310/08* (2013.01); *G09G 2320/041* (2013.01)

(58) Field of Classification Search
None
See application file for complete search history.

(56) References Cited

U.S. PATENT DOCUMENTS 6,124,851 A 9/2000 Jacobson
6,130,773 A 10/2000 Jacobson et al.
6,177,921 B1 1/2001 Comiskey et al.
6,232,950 B1 5/2001 Albert et al.
6,241,921 B1 6/2001 Jacobson et al.
6,252,564 B1 6/2001 Albert et al.
(Continued)

FOREIGN PATENT DOCUMENTS

WO 1999067678 A2 12/1999
WO 2000005704 A1 2/2000
(Continued)

OTHER PUBLICATIONS

European Patent Office, "International Search Report and Written Opinion", PCT/US2023/014237, dated May 30, 2023, dated May 30, 2023.

*Primary Examiner* — Christopher J Kohlman
(74) *Attorney, Agent, or Firm* — Jason P. Colangelo

(57) ABSTRACT

An electro-optic display includes a display stack having a layer of electro-optic material between a common electrode and an array of pixel electrodes, each associated with a display pixel. A display controller circuit is in electrical communication with the display stack, and is capable of applying waveforms to each display pixel by applying one or more time-dependent voltages between the common electrode and each pixel electrode. A temperature sensor in communication with the display controller circuit is positioned proximate to the display stack. A first plurality of look-up tables includes waveform shape data representing a plurality of shapes of waveforms the display controller circuit is capable of applying to each display pixel, and a second plurality of look-up tables includes voltage amplitude data representing a plurality of voltage amplitudes the display controller circuit is capable of applying to each display pixel to transition its optical state.

20 Claims, 5 Drawing Sheets

(56) References Cited

U.S. PATENT DOCUMENTS 6,312,304 B1 11/2001 Duthaler et al.
6,312,971 B1 11/2001 Amundson et al.
6,376,828 B1 4/2002 Comiskey
6,392,786 B1 5/2002 Albert
6,413,790 B1 7/2002 Duthaler et al.
6,422,687 B1 7/2002 Jacobson
6,445,374 B2 9/2002 Albert et al.
6,480,182 B2 11/2002 Turner et al.
6,498,114 B1 12/2002 Amundson et al.
6,506,438 B2 1/2003 Duthaler et al.
6,518,949 B2 2/2003 Drzaic
6,521,489 B2 2/2003 Duthaler et al.
6,535,197 B1 3/2003 Comiskey et al.
6,545,291 B1 4/2003 Amundson et al.
6,639,578 B1 10/2003 Comiskey et al.
6,657,772 B2 12/2003 Loxley
6,664,944 B1 12/2003 Albert et al.
D485,294 S 1/2004 Albert
6,672,921 B1 1/2004 Liang et al.
6,680,725 B1 1/2004 Jacobson
6,683,333 B2 1/2004 Kazlas et al.
6,724,519 B1 4/2004 Comiskey et al.
6,750,473 B2 6/2004 Amundson et al.
6,788,449 B2 9/2004 Liang et al.
6,816,147 B2 11/2004 Albert
6,819,471 B2 11/2004 Amundson et al.
6,825,068 B2 11/2004 Denis et al.
6,831,769 B2 12/2004 Holman et al.
6,842,167 B2 1/2005 Albert et al.
6,842,279 B2 1/2005 Amundson
6,842,657 B1 1/2005 Drzaic et al.
6,865,010 B2 3/2005 Duthaler et al.
6,866,760 B2 3/2005 Paolini, Jr. et al.
6,873,452 B2 3/2005 Tseng et al.
6,909,532 B2 6/2005 Chung et al.
6,922,276 B2 7/2005 Zhang et al.
6,967,640 B2 11/2005 Albert et al.
6,980,196 B1 12/2005 Turner et al.
6,982,178 B2 1/2006 LeCain et al.
7,002,728 B2 2/2006 Pullen et al.
7,012,600 B2 3/2006 Zehner et al.
7,012,735 B2 3/2006 Honeyman
7,030,412 B1 4/2006 Drzaic et al.
7,072,095 B2 7/2006 Liang et al.
7,075,502 B1 7/2006 Drzaic et al.
7,075,703 B2 7/2006 O'Neil et al.
7,106,296 B1 9/2006 Jacobson
7,110,163 B2 9/2006 Webber et al.
7,116,318 B2 10/2006 Amundson et al.
7,144,942 B2 12/2006 Zang et al.
7,148,128 B2 12/2006 Jacobson
7,167,155 B1 1/2007 Albert et al.
7,170,670 B2 1/2007 Webber
7,173,752 B2 2/2007 Doshi et al.
7,176,880 B2 2/2007 Amundson et al.
7,190,008 B2 3/2007 Amundson et al.
7,206,119 B2 4/2007 Honeyman et al.
7,223,672 B2 5/2007 Kazlas et al.
7,230,751 B2 6/2007 Whitesides et al.
7,256,766 B2 8/2007 Albert et al.
7,259,744 B2 8/2007 Arango et al.
7,280,094 B2 10/2007 Albert
7,301,693 B2 11/2007 Chaug et al.
7,304,780 B2 12/2007 Liu et al.
7,312,784 B2 12/2007 Baucom et al.
7,327,346 B2 2/2008 Chung et al.
7,327,511 B2 2/2008 Whitesides et al.
7,347,957 B2 3/2008 Wu et al.
7,349,148 B2 3/2008 Doshi et al.
7,352,353 B2 4/2008 Albert et al.
7,365,394 B2 4/2008 Denis et al.
7,365,733 B2 4/2008 Duthaler et al.
7,382,363 B2 6/2008 Albert et al.
7,388,572 B2 6/2008 Duthaler et al.
7,401,758 B2 7/2008 Liang et al.
7,411,719 B2 8/2008 Paolini, Jr. et al.
7,442,587 B2 10/2008 Amundson et al.
7,453,445 B2 11/2008 Amundson
7,492,497 B2 2/2009 Paolini, Jr. et al.
7,535,624 B2 5/2009 Amundson et al.
7,551,346 B2 6/2009 Fazel et al.
7,554,712 B2 6/2009 Patry et al.
7,560,004 B2 7/2009 Pereira et al.
7,583,427 B2 9/2009 Danner et al.
7,598,173 B2 10/2009 Ritenour et al.
7,605,799 B2 10/2009 Amundson et al.
7,636,191 B2 12/2009 Duthaler et al.
7,649,674 B2 1/2010 Danner et al.
7,667,886 B2 2/2010 Danner et al.
7,672,040 B2 3/2010 Sohn et al.
7,679,814 B2 3/2010 Paolini, Jr. et al.
7,688,497 B2 3/2010 Danner et al.
7,715,088 B2 5/2010 Liang et al.
7,733,335 B2 6/2010 Zehner et al.
7,785,988 B2 8/2010 Amundson et al.
7,830,592 B1 11/2010 Sprague et al.
7,839,564 B2 11/2010 Whitesides et al.
7,843,626 B2 11/2010 Amundson et al.
7,859,637 B2 12/2010 Amundson et al.
7,880,958 B2 2/2011 Zang et al.
7,893,435 B2 2/2011 Kazlas et al.
7,898,717 B2 3/2011 Patry et al.
7,905,977 B2 3/2011 Qi et al.
7,957,053 B2 6/2011 Honeyman et al.
7,986,450 B2 7/2011 Cao et al.
8,009,344 B2 8/2011 Danner et al.
8,009,348 B2 8/2011 Zehner et al.
8,027,081 B2 9/2011 Danner et al.
8,049,947 B2 11/2011 Danner et al.
8,072,675 B2 12/2011 Lin et al.
8,077,141 B2 12/2011 Duthaler et al.
8,089,453 B2 1/2012 Comiskey et al.
8,120,836 B2 2/2012 Lin et al.
8,159,636 B2 4/2012 Sun et al.
8,208,193 B2 6/2012 Patry et al.
8,237,892 B1 8/2012 Sprague et al.
8,238,021 B2 8/2012 Sprague et al.
8,362,488 B2 1/2013 Chaug et al.
8,373,211 B2 2/2013 Amundson et al.
8,389,381 B2 3/2013 Amundson et al.
8,395,836 B2 3/2013 Lin
8,437,069 B2 5/2013 Lin
8,441,414 B2 5/2013 Lin
8,456,589 B1 6/2013 Sprague et al.
8,498,042 B2 7/2013 Danner et al.
8,514,168 B2 8/2013 Chung et al.
8,547,628 B2 10/2013 Wu et al.
8,576,162 B2 11/2013 Kang et al.
8,610,988 B2 12/2013 Zehner et al.
8,714,780 B2 5/2014 Ho et al.
8,728,266 B2 5/2014 Danner et al.
8,743,077 B1 6/2014 Sprague
8,754,859 B2 6/2014 Gates et al.
8,797,258 B2 8/2014 Sprague
8,797,633 B1 8/2014 Sprague et al.
8,797,636 B2 8/2014 Yang et al.
8,830,560 B2 9/2014 Danner et al.
8,891,155 B2 11/2014 Danner et al.
8,969,886 B2 3/2015 Amundson
9,025,234 B2 5/2015 Lin
9,025,238 B2 5/2015 Chan et al.
9,030,374 B2 5/2015 Sprague et al.
9,140,952 B2 9/2015 Sprague et al.
9,147,364 B2 9/2015 Wu et al.
9,152,003 B2 10/2015 Danner et al.
9,152,004 B2 10/2015 Paolini, Jr. et al.
9,201,279 B2 12/2015 Wu et al.
9,223,164 B2 12/2015 Lai et al.
9,279,906 B2 3/2016 Kang
9,285,648 B2 3/2016 Liu et al.
9,310,661 B2 4/2016 Wu et al.
9,419,024 B2 8/2016 Amundson et al.
9,454,057 B2 9/2016 Wu et al.
9,529,240 B2 12/2016 Paolini, Jr. et al.

(56) References Cited

U.S. PATENT DOCUMENTS

| | | | |
|---|---|---|---|
| 9,582,041 | B2 | 2/2017 | Cheng et al. |
| 9,620,066 | B2 | 4/2017 | Bishop |
| 9,632,373 | B2 | 4/2017 | Huang et al. |
| 9,666,142 | B2 | 5/2017 | Hung |
| 9,671,635 | B2 | 6/2017 | Paolini, Jr. |
| 9,721,495 | B2 | 8/2017 | Harrington et al. |
| 9,778,500 | B2 | 10/2017 | Gates et al. |
| 9,841,653 | B2 | 12/2017 | Wu et al. |
| 10,037,735 | B2 | 7/2018 | Amundson |
| 10,048,563 | B2 | 8/2018 | Paolini, Jr. et al. |
| 10,048,564 | B2 | 8/2018 | Paolini, Jr. et al. |
| 10,190,743 | B2 | 1/2019 | Hertel et al. |
| 10,444,553 | B2 | 10/2019 | Laxton |
| 10,446,585 | B2 | 10/2019 | Harris et al. |
| 10,466,564 | B2 | 11/2019 | Kayal et al. |
| 10,613,407 | B2 | 4/2020 | Lin et al. |
| 2002/0060321 | A1 | 5/2002 | Kazlas et al. |
| 2004/0085619 | A1 | 5/2004 | Wu et al. |
| 2004/0105036 | A1 | 6/2004 | Danner et al. |
| 2005/0122306 | A1 | 6/2005 | Wilcox et al. |
| 2005/0122563 | A1 | 6/2005 | Honeyman et al. |
| 2006/0255322 | A1 | 11/2006 | Wu et al. |
| 2007/0052757 | A1 | 3/2007 | Jacobson |
| 2007/0075962 | A1* | 4/2007 | Zhou ..... G09G 3/344 345/107 |
| 2009/0122389 | A1 | 5/2009 | Whitesides et al. |
| 2009/0315044 | A1 | 12/2009 | Amundson et al. |
| 2010/0177396 | A1 | 7/2010 | Lin |
| 2011/0140744 | A1 | 6/2011 | Kazlas et al. |
| 2011/0187683 | A1 | 8/2011 | Wilcox et al. |
| 2011/0292319 | A1 | 12/2011 | Cole |
| 2014/0078024 | A1 | 3/2014 | Paolini, Jr. et al. |
| 2014/0192000 | A1 | 7/2014 | Hung et al. |
| 2014/0210701 | A1 | 7/2014 | Wu et al. |
| 2014/0267204 | A1* | 9/2014 | Shah ..... G09G 3/3466 345/204 |
| 2015/0005720 | A1 | 1/2015 | Zang et al. |
| 2016/0012710 | A1 | 1/2016 | Lu et al. |
| 2016/0077375 | A1 | 3/2016 | Lin |
| 2021/0312873 | A1* | 10/2021 | Cheng ..... G02F 1/167 |

FOREIGN PATENT DOCUMENTS

| | | | |
|---|---|---|---|
| WO | 2000038000 | A1 | 6/2000 |
| WO | 2005038765 | A1 | 4/2005 |

* cited by examiner

ELECTRO-OPTIC DISPLAYS

CROSS REFERENCE TO RELATED APPLICATIONS

This application claims priority to U.S. Provisional Patent Application No. 63/315,265 filed on Mar. 1, 2022, the entire contents of which are incorporated herein by reference. Further, the entire contents of any patent, published application, or other published work referenced herein are incorporated by reference in their entireties.

FIELD OF THE INVENTION

This invention relates to electro-optic display apparatuses, more particularly, to display controllers for driving the electro-optic displays.

BACKGROUND OF INVENTION

Particle-based electrophoretic displays or EPDs have been the subject of intense research and development for a number of years. In such displays, a plurality of charged particles (sometimes referred to as pigment particles) move through a fluid under the influence of an electric field. The electric field is typically provided by a conductive film or a transistor, such as a field-effect transistor. Electrophoretic displays have good brightness and contrast, wide viewing angles, state bistability, and low power consumption when compared with liquid crystal displays. Currently, electrophoretic displays can be found in everyday products such as electronic books (e-readers), mobile phones and mobile phone covers, smart cards, signs, watches, shelf labels, and flash drives.

In operation, EPD performance can change with the change in temperature. As such, there is a need to adjust EPD operation according to the temperature conditions to achieve the optimal display performance.

SUMMARY OF INVENTION

This invention provides an electro-optic display and related methods for optimizing EPD performance according to measured temperature conditions.

In one aspect, the invention features an electro-optic display including a display stack including a layer of electro-optic material disposed between a common electrode and an array of pixel electrodes, where each pixel electrode is associated with a display pixel. The electro-optic display also includes a display controller circuit in electrical communication with the display stack. The display controller circuit is capable of applying waveforms to each display pixel by applying one or more time-dependent voltages between the common electrode and each pixel electrode of the array of pixel electrodes. The electro-optic display also includes a temperature sensor in communication with the display controller circuit. The temperature sensor is positioned proximate to the display stack. The electro-optic display also includes a first plurality of look-up tables in communication with the display controller circuit. The first plurality of look-up tables includes waveform shape data representing a plurality of shapes of waveforms the display controller circuit is capable of applying to each display pixel to transition an initial optical state of each display pixel to a final optical state. The electro-optic display also includes a second plurality of look-up tables in communication with the display controller circuit. The second plurality of look-up tables includes voltage amplitude data representing a plurality of voltage amplitudes the display controller circuit is capable of applying to each display pixel to transition the initial optical state of each display pixel to the final optical state.

In some embodiments, each look-up table of the first plurality of look-up tables corresponds to one range of a first plurality of temperature ranges. In some embodiments, each range of the first plurality of temperature ranges is a subset of an operating temperature range of the electro-optic display. In some embodiments, each look-up table of the second plurality of look-up tables corresponds to one range of a second plurality of temperature ranges. In some embodiments, each range of the second plurality of temperature ranges is a subset of an operating temperature range of the electro-optic display.

In some embodiments, the display controller circuit is configured to: receive a temperature signal representing a temperature measured proximate to the display stack, select waveform shape data from a look-up table of the first plurality of look-up tables based on the temperature measured proximate to the display stack, select voltage amplitude data from a look-up table of the second plurality of look-up tables based on the temperature measured proximate to the display stack, and apply waveforms to each display pixel based on the selected waveform shape data and voltage amplitude data.

In some embodiments, the temperature measured proximate to the display stack is within a range of the first plurality of temperature ranges, and the look-up table of the first plurality of look-up tables corresponds to the range of the first plurality of temperature ranges. In some embodiments, the temperature measured proximate to the display stack is within a range of the second plurality of temperature ranges, and the look-up table of the second plurality of look-up tables corresponds to the range of the second plurality of temperature ranges.

In some embodiments, the voltage amplitude data includes voltage amplitude data representing at least four voltage amplitudes the display controller circuit is capable of applying to each display pixel to transition the initial optical state of each display pixel to the final optical state. In some embodiments, each range of the first plurality of temperature ranges is wider than each range of the second plurality of temperature ranges.

In another aspect, the invention features a method for driving an electro-optic display. The method includes providing a display stack including a layer of electro-optic material disposed between a common electrode and an array of pixel electrodes, where each pixel electrode is associated with a display pixel. The method also includes providing a display controller circuit in electrical communication with the display stack. The display controller circuit capable of applying waveforms to each display pixel by applying one or more time-dependent voltages between the common electrode and each pixel electrode of the array of pixel electrodes. The methods also includes providing a temperature sensor in communication with the display controller circuit. The temperature sensor is positioned proximate to the display stack. The methods also includes providing a first plurality of look-up tables in communication with the display controller circuit. The first plurality of look-up tables includes waveform shape data representing a plurality of shapes of waveforms the display controller circuit is capable of applying to each display pixel to transition an initial optical state of each display pixel to a final optical state. The methods also includes providing a second plurality of look-up tables in communication with the display controller circuit. The second plurality of look-up tables including voltage amplitude data representing a plurality of voltage amplitudes the display controller circuit is capable of applying to each display pixel to transition the initial optical state of each display pixel to the final optical state. The method also includes receiving a temperature signal representing a temperature measured proximate to the display stack. The method also includes selecting waveform shape data from a look-up table of the first plurality of look-up tables based on the temperature measured proximate to the display stack, and selecting voltage amplitude data from a look-up table of the second plurality of look-up tables based on the temperature measured proximate to the display stack. The method includes applying waveforms to each display pixel based on the selected waveform shape data and voltage amplitude data.

In some embodiments, each look-up table of the first plurality of look-up tables corresponds to one range of a first plurality of temperature ranges. In some embodiments, each range of the first plurality of temperature ranges is a subset of an operating temperature range of the electro-optic display. In some embodiments, each look-up table of the second plurality of look-up tables corresponds to one range of a second plurality of temperature ranges. In some embodiments, each range of the second plurality of temperature ranges is a subset of an operating temperature range of the electro-optic display.

In some embodiments, the temperature measured proximate to the display stack is within a range of the first plurality of temperature ranges, and the look-up table of the first plurality of look-up tables corresponds to the range of the first plurality of temperature ranges. In some embodiments, the temperature measured proximate to the display stack is within a range of the second plurality of temperature ranges, and the look-up table of the second plurality of look-up tables corresponds to the range of the second plurality of temperature ranges.

In some embodiments, the voltage amplitude data includes voltage amplitude data representing at least four voltage amplitudes the display controller circuit is capable of applying to each display pixel to transition the initial optical state of each display pixel to the final optical state.

In some embodiments, each range of the first plurality of temperature ranges is wider than each range of the second plurality of temperature ranges.

In some embodiments, the method includes determining a DC balance pulse to apply to each display pixel based on the waveforms applied to each display pixel based on the selected waveform shape data and voltage amplitude data.

BRIEF DESCRIPTION OF DRAWINGS

Various aspects and embodiments of the application will be described with reference to the following figures. It should be appreciated that the figures are not necessarily drawn to scale. Further, the drawings are only intended to facilitate the description of the subject matter. The drawings do not illustrate every aspect of the described embodiments and do not limit the scope of the present disclosure or claims.

DETAILED DESCRIPTION

Figure 2:
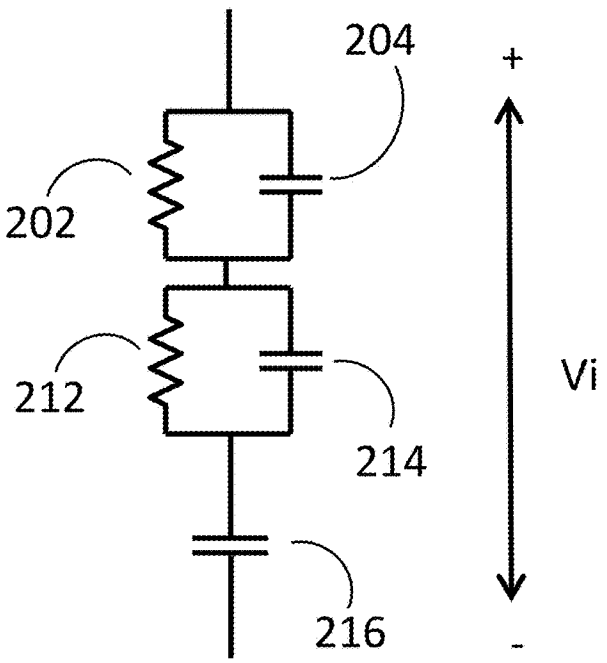
FIG. 2 illustrates an equivalent circuit of the electrophoretic display presented in FIG. 1 in accordance with the subject matter disclosed herein.

As indicated above, the subject matter presented herein provides methods and means to reduce charge built up in the electrophoretic display medium and improve electro-optic display performances.

The term "electro-optic" as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the E Ink patents and published applications referred to below describe electrophoretic displays in which the extreme states are white and deep blue, so that an intermediate "gray state" would actually be pale blue. Indeed, as already mentioned, the change in optical state may not be a color change at all. The terms "black" and "white" may be used hereinafter to refer to the two extreme optical states of a display, and should be understood as normally including extreme optical states which are not strictly black and white, for example the aforementioned white and dark blue states. The term "monochrome" may be used hereinafter to denote a drive scheme which only drives pixels to their two extreme optical states with no intervening gray states.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "impulse" is used herein in its conventional meaning of the integral of voltage with respect to time.

However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

Numerous patents and applications assigned to or in the names of the Massachusetts Institute of Technology (MIT) and E Ink Corporation have recently been published describing encapsulated electrophoretic media. Such encapsulated media comprise numerous small capsules, each of which itself comprises an internal phase containing electrophoretically-mobile particles suspended in a liquid suspension medium, and a capsule wall surrounding the internal phase. Typically, the capsules are themselves held within a polymeric binder to form a coherent layer positioned between two electrodes. The technologies described in these patents and applications include:

(a) Electrophoretic particles, fluids and fluid additives; see for example U.S. Pat. Nos. 7,002,728 and 7,679,814;

(b) Capsules, binders and encapsulation processes; see for example U.S. Pat. Nos. 6,922,276 and 7,411,719;

(c) Microcell structures, wall materials, and methods of forming microcells; see for example U.S. Pat. Nos. 7,072,095 and 9,279,906;

(d) Methods for filling and sealing microcells; see for example U.S. Pat. Nos. 7,144,942 and 7,715,088;

(e) Films and sub-assemblies containing electro-optic materials; see for example U.S. Pat. Nos. 6,982,178 and 7,839,564;

(f) Backplanes, adhesive layers and other auxiliary layers and methods used in displays; see for example U.S. Pat. Nos. D485,294; 6,124,851; 6,130,773; 6,177,921; 6,232,950; 6,252,564; 6,312,304; 6,312,971; 6,376,828; 6,392,786; 6,413,790; 6,422,687; 6,445,374; 6,480,182; 6,498,114; 6,506,438; 6,518,949; 6,521,489; 6,535,197; 6,545,291; 6,639,578; 6,657,772; 6,664,944; 6,680,725; 6,683,333; 6,724,519; 6,750,473; 6,816,147; 6,819,471; 6,825,068; 6,831,769; 6,842,167; 6,842,279; 6,842,657; 6,865,010; 6,873,452; 6,909,532; 6,967,640; 6,980,196; 7,012,735; 7,030,412; 7,075,703; 7,106,296; 7,110,163; 7,116,318; 7,148,128; 7,167,155; 7,173,752; 7,176,880; 7,190,008; 7,206,119; 7,223,672; 7,230,751; 7,256,766; 7,259,744; 7,280,094; 7,301,693; 7,304,780; 7,327,511; 7,347,957; 7,349,148; 7,352,353; 7,365,394; 7,365,733; 7,382,363; 7,388,572; 7,401,758; 7,442,587; 7,492,497; 7,535,624; 7,551,346; 7,554,712; 7,583,427; 7,598,173; 7,605,799; 7,636,191; 7,649,674; 7,667,886; 7,672,040; 7,688,497; 7,733,335; 7,785,988; 7,830,592; 7,843,626; 7,859,637; 7,880,958; 7,893,435; 7,898,717; 7,905,977; 7,957,053; 7,986,450; 8,009,344; 8,027,081; 8,049,947; 8,072,675; 8,077,141; 8,089,453; 8,120,836; 8,159,636; 8,208,193; 8,237,892; 8,238,021; 8,362,488; 8,373,211; 8,389,381; 8,395,836; 8,437,069; 8,441,414; 8,456,589; 8,498,042; 8,514,168; 8,547,628; 8,576,162; 8,610,988; 8,714,780; 8,728,266; 8,743,077; 8,754,859; 8,797,258; 8,797,633; 8,797,636; 8,830,560; 8,891,155; 8,969,886; 9,147,364; 9,025,234; 9,025,238; 9,030,374; 9,140,952; 9,152,003; 9,152,004; 9,201,279; 9,223,164; 9,285,648; and 9,310,661; and U.S. Patent Applications Publication Nos. 2002/0060321; 2004/0008179; 2004/0085619; 2004/0105036; 2004/0112525; 2005/0122306; 2005/0122563; 2006/0215106; 2006/0255322; 2007/0052757; 2007/0097489; 2007/0109219; 2008/0061300; 2008/0149271; 2009/0122389; 2009/0315044; 2010/0177396; 2011/0140744; 2011/0187683; 2011/0187689; 2011/0292319; 2013/0250397; 2013/0278900; 2014/0078024; 2014/0139501; 2014/0192000; 2014/0210701; 2014/0300837; 2014/0368753; 2014/0376164; 2015/0171112; 2015/0205178; 2015/0226986; 2015/0227018; 2015/0228666; 2015/0261057; 2015/0356927; 2015/0378235; 2016/077375; 2016/0103380; and 2016/0187759; and International Application Publication No. WO 00/38000; European Patents Nos. 1,099,207 B1 and 1,145,072 B 1;

(g) Color formation and color adjustment; see for example U.S. Pat. Nos. 7,075,502 and 7,839,564;

(h) Methods for driving displays; see for example U.S. Pat. Nos. 7,012,600 and 7,453,445;

(i) Applications of displays; see for example U.S. Pat. Nos. 7,312,784 and 8,009,348;

(j) Non-electrophoretic displays, as described in U.S. Pat. No. 6,241,921; and U.S. Patent Applications Publication No. 2015/0277160; and U.S. Patent Application Publications Nos. 2015/0005720 and 2016/0012710.

All of the above patents and patent applications are incorporated herein by reference in their entireties.

Many of the aforementioned patents and applications recognize that the walls surrounding the discrete microcapsules in an encapsulated electrophoretic medium could be replaced by a continuous phase, thus producing a so-called polymer-dispersed electrophoretic display in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned 2002/0131147. Accordingly, for purposes of the present application, such polymer-dispersed electrophoretic media are regarded as sub-species of encapsulated electrophoretic media.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; inkjet printing processes; and other similar techniques.) Thus, the resulting display can be flexible. Further, because the display medium can be printed (using a variety of methods), the display itself can be made inexpensively.

A related type of electrophoretic display is a so-called "microcell electrophoretic display". In a microcell electrophoretic display, the charged particles and the suspending fluid are not encapsulated within microcapsules but instead are retained within a plurality of cavities formed within a carrier medium, typically a polymeric film. See, for example, International Application Publication No. WO 02/01281, and published U.S. Application No. 2002/0075556, both assigned to Sipix Imaging, Inc.

The aforementioned types of electro-optic displays are bistable and are typically used in a reflective mode, although as described in certain of the aforementioned patents and applications, such displays may be operated in a "shutter mode" in which the electro-optic medium is used to modulate the transmission of light, so that the display operates in a transmissive mode. Liquid crystals, including polymer-dispersed liquid crystals, are, of course, also electro-optic media, but are typically not bistable and operate in a transmissive mode. Certain embodiments of the invention described below are confined to use with reflective displays, while others may be used with both reflective and transmissive displays, including conventional liquid crystal displays.

Whether a display is reflective or transmissive, and whether or not the electro-optic medium used is bistable, to obtain a high-resolution display, individual pixels of a display must be addressable without interference from adjacent pixels. One way to achieve this objective is to provide an array of non-linear elements, such as transistors or diodes, with at least one non-linear element associated with each pixel, to produce an "active matrix" display. An addressing or pixel electrode, which addresses one pixel, is connected to an appropriate voltage source through the associated non-linear element. Typically, when the non-linear element is a transistor, the pixel electrode is connected to the drain of the transistor, and this arrangement will be assumed in the following description, although it is essentially arbitrary and the pixel electrode could be connected to the source of the transistor. Conventionally, in high resolution arrays, the pixels are arranged in a two-dimensional array of rows and columns, such that any specific pixel is uniquely defined by the intersection of one specified row and one specified column. The sources of all the transistors in each column are connected to a single column electrode, while the gates of all the transistors in each row are connected to a single row electrode; again the assignment of sources to rows and gates to columns is conventional but essentially arbitrary, and could be reversed if desired. The row electrodes are connected to a row driver, which essentially ensures that at any given moment only one row is selected, i.e., that there is applied to the selected row electrode a voltage such as to ensure that all the transistors in the selected row are conductive, while there is applied to all other rows a voltage such as to ensure that all the transistors in these non-selected rows remain non-conductive. The column electrodes are connected to column drivers, which place upon the various column electrodes voltages selected to drive the pixels in the selected row to their desired optical states. (The aforementioned voltages are relative to a common front electrode which is conventionally provided on the opposed side of the electro-optic medium from the non-linear array and extends across the whole display.) After a pre-selected interval known as the "line address time" the selected row is deselected, the next row is selected, and the voltages on the column drivers are changed to that the next line of the display is written. This process is repeated so that the entire display is written in a row-by-row manner.

Processes for manufacturing active matrix displays are well established. Thin-film transistors, for example, can be fabricated using various deposition and photolithography techniques. A transistor includes a gate electrode, an insulating dielectric layer, a semiconductor layer and source and drain electrodes. Application of a voltage to the gate electrode provides an electric field across the dielectric layer, which dramatically increases the source-to-drain conductivity of the semiconductor layer. This change permits electrical conduction between the source and the drain electrodes. Typically, the gate electrode, the source electrode, and the drain electrode are patterned. In general, the semiconductor layer is also patterned in order to minimize stray conduction (i.e., cross-talk) between neighboring circuit elements.

Liquid crystal displays commonly employ amorphous silicon ("a-Si"), thin-film transistors ("TFTs") as switching devices for display pixels. Such TFTs typically have a bottom-gate configuration. Within one pixel, a thin film capacitor typically holds a charge transferred by the switching TFT. Electrophoretic displays can use similar TFTs with capacitors, although the function of the capacitors differs somewhat from those in liquid crystal displays; see the aforementioned copending Application Ser. No. 09/565,413, and Publications 2002/0106847 and 2002/0060321. Thin film transistors can be fabricated to provide high performance. Fabrication processes, however, can result in significant cost.

In TFT addressing arrays, pixel electrodes are charged via the TFTs during a line address time. During the line address time, a TFT is switched to a conducting state by changing an applied gate voltage. For example, for an n-type TFT, a gate voltage is switched to a "high" state to switch the TFT into a conducting state.

Furthermore, unwanted effects such as voltage shifts may be caused by crosstalk occurring between a data line supplying driving waveforms to the display pixel and the pixel electrode. Similar to the voltage shift described above, crosstalk between the data line and the pixel electrode can be caused by capacitive coupling between the two even when the display pixel is not being addressed (e.g., associated pixel TFT in depletion). Such crosstalk can result in voltage shifts that are undesirable because it can lead to optical artifacts such as image streaking.

In some cases, an electrophoretic display or EPD may include two substrates (e.g., plastic or glass) where a front plane laminate or FPL is positioned between the two substrates. In some embodiments, the bottom portion of the top substrate may be coated with a transparent conductive material to function as a conductive electrode (i.e., the $V_{com}$ plane). The top portion of the lower substrate may include an array of electrode elements (e.g., conductive electrodes for each display pixel). A semiconductor switch, such as a thin film transistor or TFT, may be associated with each of these pixel electrodes. Application of a bias voltage to a pixel electrode and the $V_{com}$ plane may result in an electro-optical transformation of the FPL. This optical transformation can be used as a basis for the display of text or graphical information on the EPD. To display a desired image, a proper voltage needs to be applied to each pixel electrode.

Figure 1:
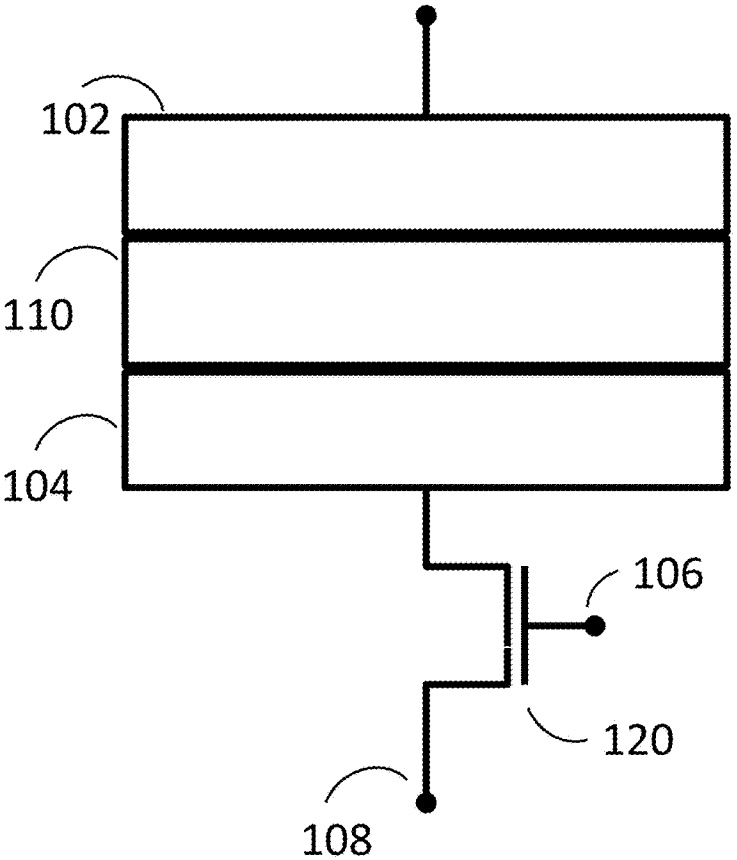
FIG. 1 illustrates an electrophoretic display in accordance with the subject matter disclosed herein.

FIG. 1 illustrates a schematic model of a display pixel 100 of an electro-optic display in accordance with the subject matter presented herein. Pixel 100 may include an imaging film 110. In some embodiments, imaging film 110 may be a layer of electrophoretic material and bistable in nature. This electrophoretic material may include a plurality of electrically charged color pigment particles (e.g., black, white, yellow or red) disposed in a fluid and capable of moving through the fluid under the influence of an electric field. In some embodiments, imaging film 110 may be an electrophoretic film having micro-cells with charged pigment particles. In some embodiments, imaging film 110 may include, without limitation, an encapsulated electrophoretic imaging film, which may include, for example, charged pigment particles. It should be appreciated that the driving method presented below can be adopted for either type of electrophoretic material (e.g., an encapsulated electrophoretic medium or a film with micro-cells).

In some embodiments, imaging film 110 may be disposed between a front electrode 102 and a rear or pixel electrode 104. Front electrode 102 may be formed between the imaging film and the front of the display. In some embodiments, front electrode 102 may be transparent and light-transmissive. In some embodiments, front electrode 102 may be formed of any suitable transparent material, including, without limitation, indium tin oxide ("ITO"). Rear electrode 104 may be formed on an opposed side of the imaging film 110 to the front electrode 102. In some embodiments, a parasitic capacitance (not shown) may be formed between front electrode 102 and rear electrode 104.

Pixel 100 may be one of a plurality of pixels. The plurality of pixels may be arranged in a two-dimensional array of rows and columns to form a matrix, such that any specific pixel is uniquely defined by the intersection of one specified row and one specified column. In some embodiments, the matrix of pixels may be an "active matrix," in which each pixel is associated with at least one non-linear circuit element 120. The non-linear circuit element 120 may be coupled between back-plate electrode 104 and an addressing electrode 108. In some embodiments, non-linear element 120 may include a diode and/or a transistor, including, without limitation, a MOSFET or a Thin-Film Transistor ("TFT"). The drain (or source) of the MOSFET or TFT may be coupled to back-plate or pixel electrode 104, the source (or drain) of the MOSFET or TFT may be coupled to the addressing electrode 108, and the gate of the MOSFET or TFT may be coupled to a driver electrode 106 configured to control the activation and deactivation of the MOSFET or TFT. (For simplicity, the terminal of the MOSFET or TFT coupled to back-plate electrode 104 will be referred to as the MOSFET or TFT's drain, and the terminal of the MOSFET or TFT coupled to addressing electrode 108 will be referred to as the MOSFET or TFT's source. However, one of ordinary skill in the art will recognize that, in some embodiments, the source and drain of the MOSFET or TFT may be interchanged.)

In some embodiments of the active matrix, the addressing electrodes 108 of all the pixels in each column may be connected to a same column electrode, and the driver electrodes 106 of all the pixels in each row may be connected to a same row electrode. The row electrodes may be connected to a row driver, which may select one or more rows of pixels by applying to the selected row electrodes a voltage sufficient to activate the non-linear elements 120 of all the pixels 100 in the selected row(s). The column electrodes may be connected to column drivers, which may place upon the addressing electrode 106 of a selected (activated) pixel a voltage suitable for driving the pixel into a desired optical state. The voltage applied to an addressing electrode 108 may be relative to the voltage applied to the pixel's front-plate electrode 102 (e.g., a voltage of approximately zero volts). In some embodiments, the front-plate electrodes 102 of all the pixels in the active matrix may be coupled to a common electrode.

In some embodiments, the pixels 100 of the active matrix may be written in a row-by-row manner. For example, a row of pixels may be selected by the row driver, and the voltages corresponding to the desired optical states for the row of pixels may be applied to the pixels by the column drivers. After a pre-selected interval known as the "line address time," the selected row may be deselected, another row may be selected, and the voltages on the column drivers may be changed so that another line of the display is written.

Figure 3:
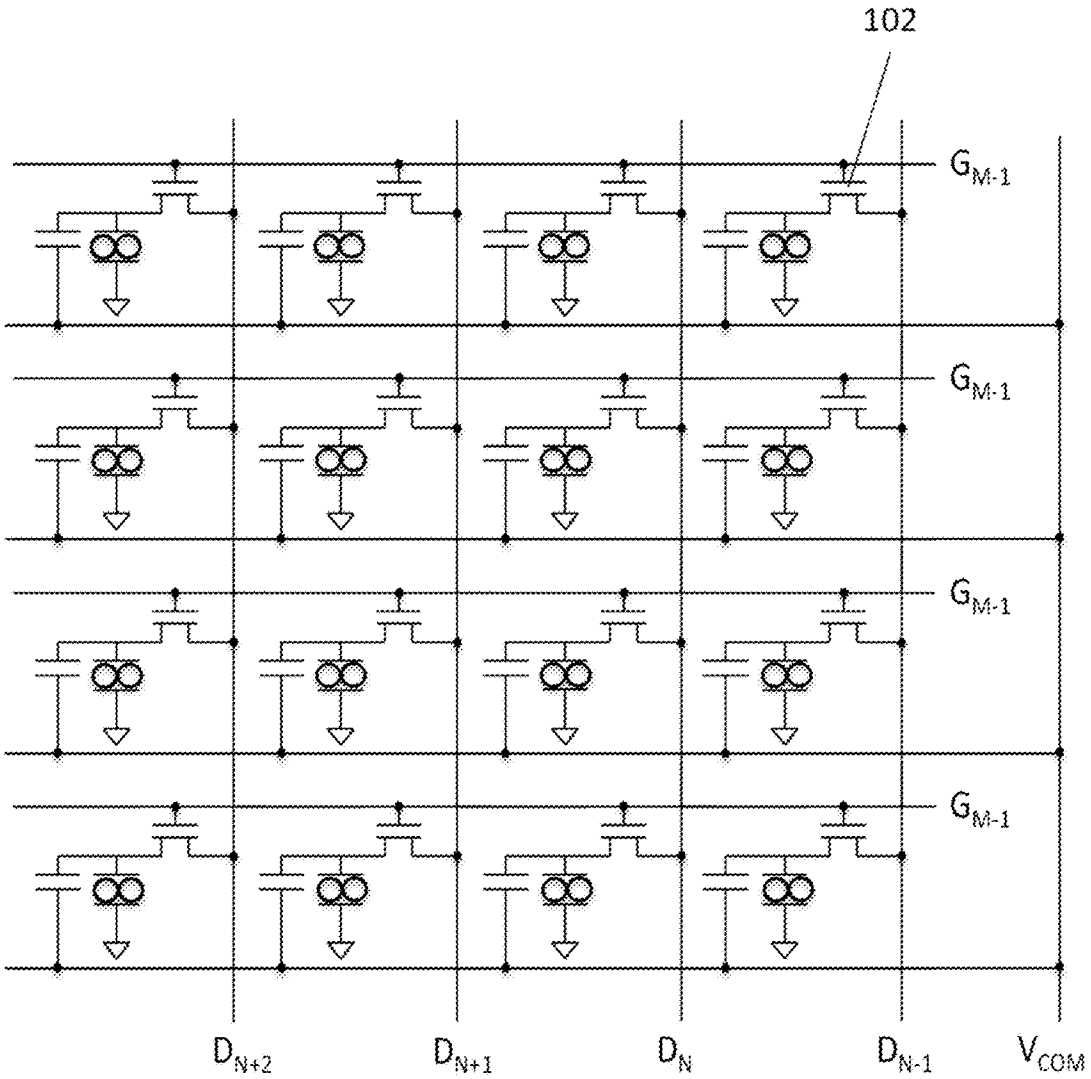
FIG. 3 illustrates an active matrix circuit in accordance with the subject matter disclosed herein.

FIG. 2 illustrates a circuit model of the electro-optic imaging layer 110 disposed between the front electrode 102 and the rear electrode 104 in accordance with the subject matter presented herein. Resistor 202 and capacitor 204 may represent the resistance and capacitance of the electro-optic imaging layer 110, the front electrode 102 and the rear electrode 104, including any adhesive layers. Resistor 212 and capacitor 214 may represent the resistance and capacitance of a lamination adhesive layer. Capacitor 216 may represent a capacitance that may form between the front electrode 102 and the back electrode 104, for example, interfacial contact areas between layers, such as the interface between the imaging layer and the lamination adhesive layer and/or between the lamination adhesive layer and the back-plane electrode. A voltage Vi across a pixel's imaging film 110 may include the pixel's remnant voltage. FIG. 3 illustrates an exemplary active matrix for driving an electrophoretic display. In some embodiments, each display pixel of the electrophoretic display may be controlled by a thin-film-transistor (TFT). This TFT may be turned on and off to receive driving voltages to modulate optical states of the associated display pixel. To effectively control the driving of the associated display pixel, each TFT 102 may be provided with a gate line signal, a data line signal, $V_{com}$ line signal and a storage capacitor. In one embodiment, as illustrated in FIG. 1, the gate of each TFT 102 may be electrically coupled to a scan line, and the source or drain of the transistor may be connected to a data line, and the two terminals of the storage capacitor may be connected to a $V_{com}$ line and pixel the pixel electrode, respectively. In some embodiments, the $V_{com}$ on the bottom portion of the top substrate and the $V_{com}$ line grid on the top portion of the bottom substrate may be connected to the same DC source.

Figure 4:
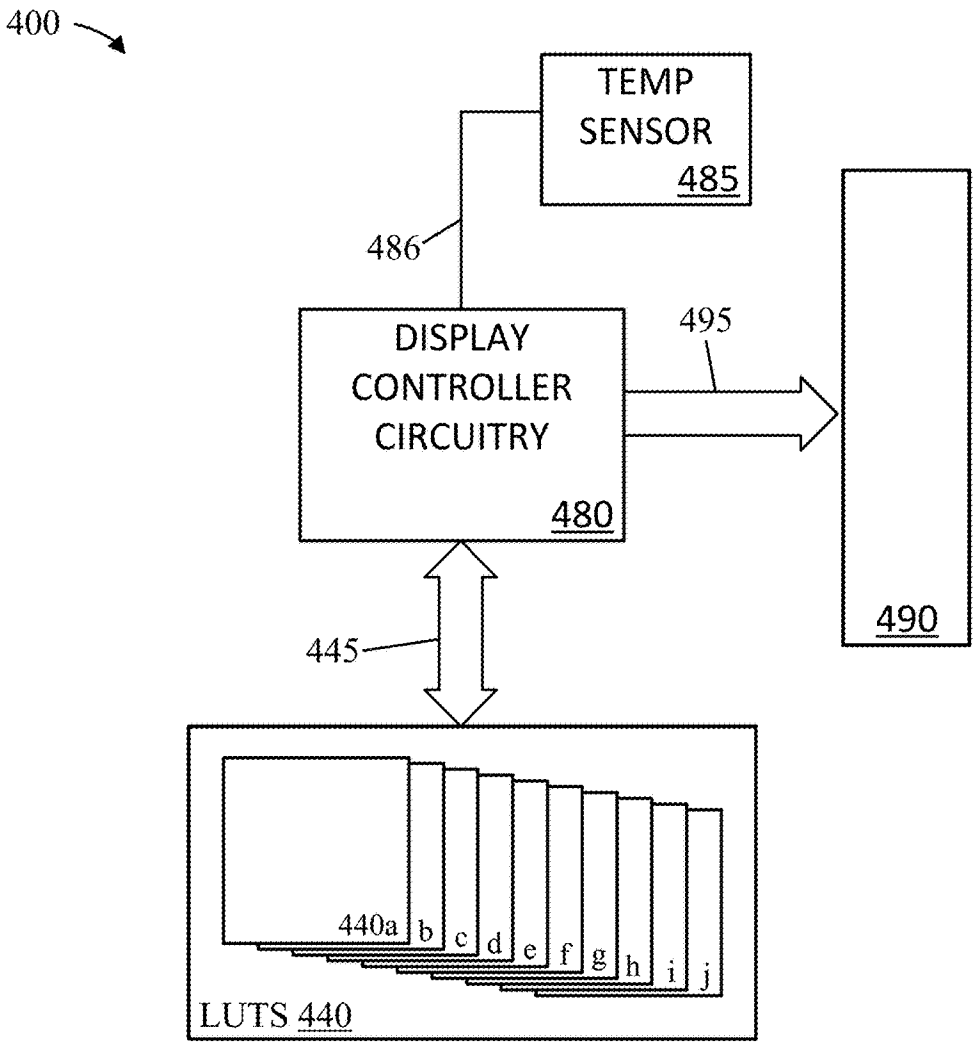
FIG. 4 is a block diagram of an exemplary conventional electrophoretic display.

FIG. 4 is a block diagram of an exemplary conventional electrophoretic display 400. The electrophoretic display 400 includes display controller circuitry 480, a display stack 490, look-up tables **440*a*-440*j* (collectively referred to as look-up tables 440 or LUTs 440), and a temperature sensor 485**.

The display stack 490 includes an array of display pixels arranged in an active matrix as described above in connection with FIGS. 1-3. One of skill in the art will appreciate that other display configurations are within the scope of the present disclosure. (The structures of electrophoretic displays and the component parts, pigments, adhesives, electrode materials, etc., are described in many patents and patent applications published by E Ink Corporation, such as U.S. Pat. Nos. 6,922,276; 7,002,728; 7,072,095; 7,116,318; 7,715,088; and 7,839,564, all of which are incorporated by reference herein in their entireties.)

The display controller circuitry 480 represents the circuits and components that provide the supply voltages and control signals 495 necessary to operate the electrophoretic display 400. For example, the display controller circuitry 480 can include power management circuitry for generating and supplying multiple voltages to the display stack 490 along with row and column drivers for addressing the array of pixel electrodes and driving waveforms sufficient to change the optical state of the display stack 490. In some embodiments, the transistors used for addressing and driving the pixel electrodes are positioned in proximity to the array of pixel electrodes.

One of skill in the art will appreciate that the display controller circuitry 480 of the present invention can be implemented in a number of different physical forms and can utilize a variety of analog and digital components. For example, the display controller circuitry 480 can include a general purpose microprocessor in conjunction with appropriate peripheral components (for example, one or more digital-to-analog converters, "DACs") to convert the digital outputs from the microprocessor to appropriate voltages for application to pixels. Alternatively, the display controller circuitry 480 can be implemented in an application specific integrated circuit ("ASIC") or field programmable gate array ("FPGA"). One of skill in the art will appreciate that the display controller circuitry 480 can include both processing components and power management circuitry.

Look-up tables 440 comprise waveforms (sequence of voltages to be applied over time) that are applied by the display controller circuitry 480 to drive the display pixels of the display stack 490 from one optical state to another. In some embodiments, look-up tables 440 each comprises a two dimensional matrix, with one axis of the matrix representing an initial state of the display pixel and the other axis representing the desired final state of the display pixel. Although LUTs 440 are shown in FIG. 4 as being separate from the display controller circuitry 480, in some embodiments, LUTs 440 are incorporated into the display controller circuitry 480.

In general, the entries in the look-up tables 440 comprise data representing the voltage impulses necessary to drive a display pixel in an initial optical state to a desired optical state. Each entry, in effect, defines the time-varying voltage waveform(s) needed to effect the transition from the initial state to the final state, and typically comprises a series of integers representing the voltages to be applied to the display pixel electrodes during each frame of a sequence of frames.

The entries of the look-up tables 440 may have a variety of forms. In some embodiments, each element comprises a single number. For example, an electro-optic display may use a high precision voltage modulated driver circuit capable of outputting numerous different voltages both above and below a reference voltage, and simply apply the required voltage to a display pixel for a standard, predetermined period of time. In such a case, each entry in the look-up tables 440 could simply have the form of a signed integer specifying which voltage is to be applied to a given display pixel. In other cases, each element may comprise a series of numbers relating to different portions of a waveform. For example, some driving schemes use so-called single- or double-prepulse waveforms, and specifying such waveforms necessarily requires several numbers relating to different portions of the waveform.

In some embodiments, pulse length modulation is used to apply a predetermined voltage to a display pixel during selected ones of a plurality of sub-scan periods (frames) during a complete scan (superframe). In such an embodiment, the elements of the look-up tables 440 may have the form of a series of bits specifying whether or not the predetermined voltage is to be applied during each sub-scan period (frame) of the relevant transition.

Finally, as discussed in more detail below, the entries in the look-up tables 440 can be organized to include temperature-compensation information. For example, the look-up table 440 entries can also include information indicating a change in the voltage level to be applied to a display pixel in response to a measured change in temperature in proximity to the display stack 490. In some embodiments, the temperature-compensation information comprises a numerical value indicating a specific voltage level to apply to the display pixel during a corresponding waveform. In some embodiments, the temperature-compensation information comprises a coefficient that indicates to the display controller circuitry 480 to increase or decrease a voltage level applied to a display pixel during a particular waveform.

One of skill in the art will appreciate that the look-up tables 440 may be of different sizes depending on the display application. For example, if the display stack 490 comprises a display capable of displaying 16 gray levels (e.g., a 4-bit display), a full gray scale look-up table requires 256 entries (16 initial states times 16 final states) whereas a look-up table for a monochrome area of the display requires only 4 entries.

It has been found that the final optical state of a display pixel after application of a particular driving waveform can depend on the initial optical state, and also on one or more prior optical states of that display pixel at specific times prior to the initial state. Accordingly, in some embodiments, the look-up tables 440 comprise additional information about one or more prior optical states of each display pixel. However, depending upon the number of prior states stored, the look-up tables 440 can become very large. To take an extreme example, consider a display with 256 ($2^8$) gray levels using an algorithm that takes account of initial, final and two prior display pixel states. The necessary four-dimensional look-up table has 232 entries. If each entry requires, for example, 64 bits (8 bytes), the total size of the look-up table would be approximately 32 Gbytes. While storing this amount of data poses no problems for a desktop computer, it may present problems in a portable device such as an e-reader.

In some embodiments, the display controller circuitry 480 includes a timing controller ("Tcon") integrated circuit ("IC") that accepts incoming image data and outputs control signals to a collection of data and select driver ICs (e.g., row and column driver ICs) in order to produce the proper waveforms and voltages at the pixel electrodes to display the desired image. For example, when an image update is being carried out, the display controller circuitry 480 compares the currently displayed image with the next image that will be displayed. Based on the comparison, the Tcon consults the look-up tables 440 to find the appropriate waveform and voltage potential for each pixel of the display stack 490. More specifically, when driving from the current image to the next image, a driving waveform and voltage level is selected from the look up table for each pixel, depending on the color states of the two consecutive images of that pixel. For example, for a pixel that is in a white state in the current image and will be in a level 5 grey state in the next image, the Tcon selects a waveform and voltage level that will effect the color change.

In some embodiments, a host controller in communication with the display controller circuit requests an update to the electrophoretic display 400 and supplies the image data for the update to the display controller circuit. In some embodiments, the display controller circuitry 480 accepts the image data through access to a memory buffer that contains the image data, or receives a signal from which the image data is extracted. In some embodiments, the memory buffer has a structure such as those described in U.S. Pat. No. 9,721,495. In some embodiments, the display controller circuitry 480 receives serial signals containing the information required to perform the necessary calculations to generate drive impulses (e.g., driving waveforms) to apply to the electrophoretic medium during scans of the pixel array.

Once the driving waveforms and voltages are selected from LUTs 440, they are applied to the display pixels of the display stack 490 to drive the current image to the next image. The driving waveforms are sent frame by frame to the display stack 490.

The temperature sensor 485 measures the temperature of the electrophoretic medium, or the environment immediately adjacent thereto, and provides temperature information to the display controller circuitry 480 via interface 486. In some embodiments, the temperature sensor 485 is positioned within the encapsulated electrophoretic medium of the display stack 490. In some embodiments, the temperature sensor 485 comprises multiple temperature sensors positioned at different physical locations around or within the display stack 490.

The temperature sensor 485 can be a sensor for which an electric property such as a resistance value or a capacitance value changes in response to fluctuations in temperature. In some embodiments, the temperature sensor 485 comprises a thermocouple, a resistance temperature detector ("RTD"), and/or a thermistor (e.g., a Negative Temperature Coefficient ("NTC") thermistor). In some embodiments, the temperature sensor 485 comprises a semiconductor-based integrated circuit for sensing temperature.

In some embodiments, interface 486 is a serial or multi-signal/parallel bus interface that the temperature sensor 485 uses for communicating temperature information to the display controller circuitry 480. For example, interface 486 can be signal connected to a general purpose input/output (GPIO) of the display controller circuitry 480. In some embodiments, interface 486 is a low pin-count peripheral interface (e.g., Inter-Integrated Circuit (I2C), Serial Peripheral Interface (SPI), Controller Area Network (CAN) bus, etc.).

The optical performance of an EPD can be affected by variations in ambient temperature. Accordingly, an EPD module such as electrophoretic display 400 can include one or more temperature sensors 485 for acquiring information about the temperature at one or more locations of the EPD module, typically in proximity to the electrophoretic medium. The temperature sensors 485 send the temperature information to the timing controller associated with the display controller circuitry 480.

In conventional EPD modules, the Tcon can be configured to select sets of waveforms from LUTs 440 that are optimized to most accurately effect a desired optical change for a particular measured temperature or temperature range. For example, for a given temperature range of 0° to 50° Celsius, LUTs 440 can be divided into a set of ten LUTs, LUTs 440*a*-440*j*, with each LUT storing driving waveform and voltage level information configured to cover a 5° Celsius temperature range. For example, LUT 440*a* can include driving waveform and voltage level information optimized for driving display pixels when the measured temperature is in the range of 0° to 4° Celsius. Similarly, LUT 440*b* can include driving waveform and voltage level information optimized for driving display pixels when the measured temperature is in the range of 5° to 9° Celsius, and so on, with LUT 440*j* including driving waveform and voltage level information optimized for driving display pixels when the measured temperature is in the range of 45° to 50° Celsius. As described, LUT 440*j* actually stores driving waveform and voltage level information for a 6-degree Celsius temperature range. However, electrophoretic displays tend to have more variation in performance at lower temperatures, the trade-off is made to have less precision at the higher temperatures.

It has been observed that the voltage levels of the driving waveforms required to achieve optimal EPD performance when applied to the EPD's display pixels can vary significantly within a 5-degree Celsius range. Therefore a conventional configuration using one LUT to store the driving waveform and voltage level for a 5-degree Celsius range can be insufficient to optimize display performance. As noted above, the size of each LUT can be increased, or additional LUTs can be added to increase the temperature-granularity of the information stored in each LUT. However, increasing the number of LUTs to cover more temperature ranges requires a larger memory allocation within the flash memory or the one-time programmable memory or OTP of the electrophoretic display 400. As these memories are generally components of the EPD module, increasing the size of number of LUTs also undesirably increases the cost of the EPD module.

According to embodiments of the present invention, instead of adding more LUTs to store driving waveform and voltage level information to cover additional temperature ranges, the voltage values of the waveforms applied can instead be modified.

Figure 5:
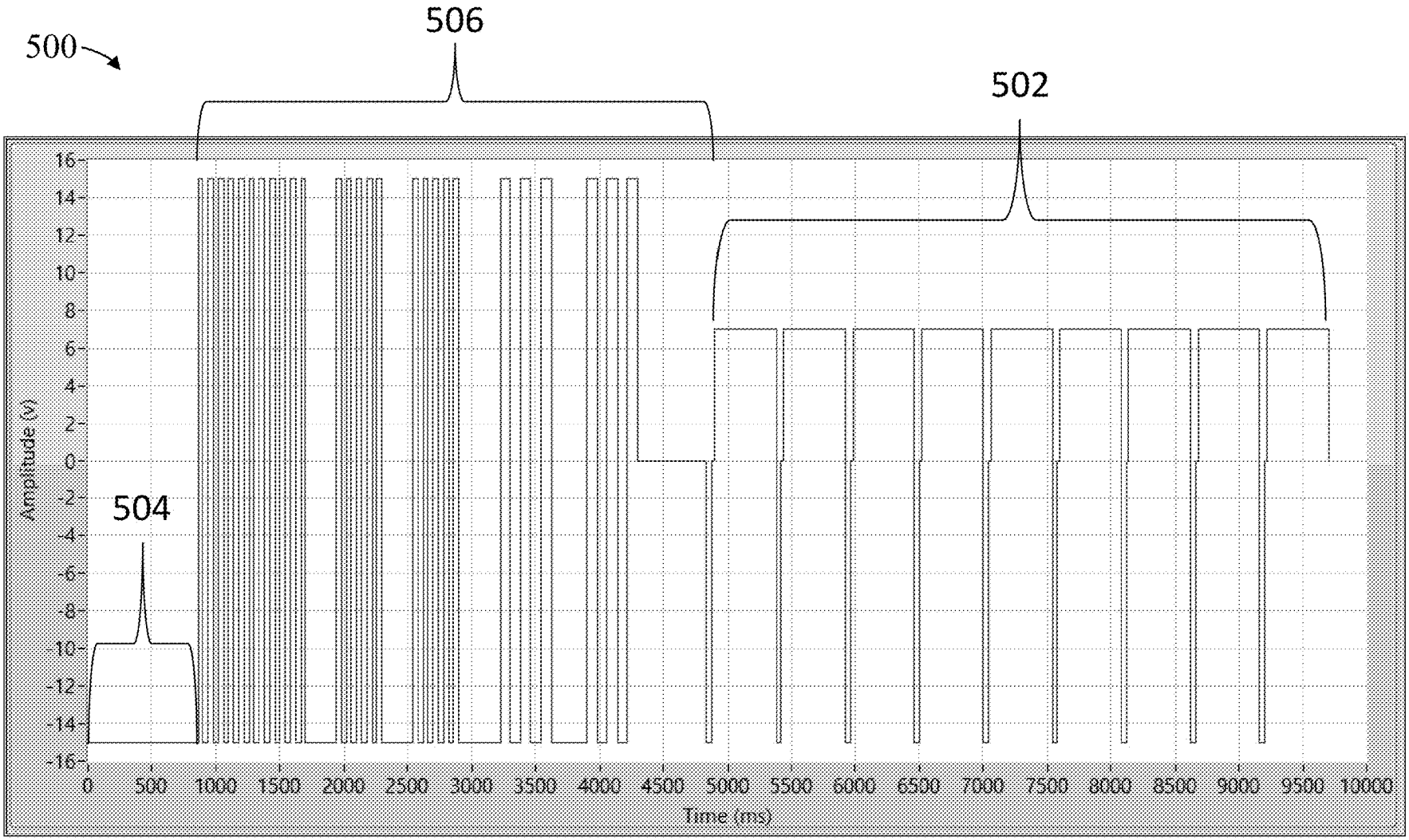
FIG. 5 is an exemplary waveform diagram showing waveforms configured to drive a display pixel to the color red for a conventional three-, four-, five-, or more particle EPD system, in accordance with the subject matter described herein.

Referring now to FIG. 5, illustrated is an exemplary waveform diagram 500 showing waveforms configured to drive a display pixel to the color red for a conventional three-, four-, five-, or more particle EPD system. As illustrated, the waveform 500 includes a DC balance pulse portion 404, a shaking and reset portion 406, and a smaller positive voltage portion 402 (also referred to herein as VPOS_low 402).

The shaking and reset portion 406 is used to separate the charged ink particles from each other and bring them into a mixed state in the display fluid, then to drive the particles to a known state prior to driving the display pixel to the desired optical state.

During VPOS_low 402, the positive amplitude of the waveforms applied to the display pixel is smaller than the positive amplitude of the waveforms applied during other periods such as the shaking and reset portion 406. For example, as shown in FIG. 5, the positive amplitude of the waveforms applied during VPOS_low 402 is approximately 7V, while the positive amplitude of the waveforms applied during the shaking and reset portion 406 is approximately 15V. In some embodiments, the voltage applied during the VPOS_low portion 402 is configured to give the best optical performance for displaying the color red (e.g., the highest red a* value). Although not shown in FIG. 5, in some embodiments, the negative amplitude of the waveforms applied to the display pixel can be reduced for a portion of the time the display pixel is driven. In some embodiments, a negative voltage having an amplitude of approximately −7V is applied during a VNEG_low portion, while a negative voltage having an amplitude of approximately −15V is applied at other times the display pixel is being updated.

In practice, an electrophoretic display can be configured to not only include LUTs storing information describing waveforms to cover a plurality of temperature ranges, but to also include LUTs storing voltage value information for the VPOS_low portion 502 (and/or VNEG_low portion) for even smaller temperature ranges. In one embodiment, the same number of LUTs as in FIG. 4 (e.g., 10) can be used to store information about waveform shapes for use over the temperature range of 0° to 50° Celsius (e.g., a 5-degree range per LUT), and additional LUTs can be included to store voltage level information, including the smaller positive and/or negative voltage values, with an increased precision of a set of voltage level values for every one degree change in temperature.

Significantly less memory is required to store the voltage level values, as several voltage values can be encoded into a small number of bits. As one example, just 3 bits can represent $2^3$ or 8 unique voltage values. Accordingly, only two additional LUTs are needed to store the voltage level information, despite the increased precision. For example, one of the additional LUTs can store voltage value information for temperatures in the range of 0° to 24° Celsius, and the other additional LUT can store voltage value information for temperatures in the range of 25° to 50° Celsius.

In this configuration, the Tcon can select waveform shape information from one LUT for a first range of temperature values (e.g., 5 degrees Celsius), and also select voltage value information from another LUT with a granularity of one degree Celsius. For example, when an electrophoretic display is operating at a temperature of 23° Celsius, a temperature sensor forwards the temperature information to the Tcon associated with the display. The Tcon can pick one waveform shape LUT designated for the temperature range of 20° to 25° Celsius. Furthermore, the Tcon can also choose a LUT to retrieve the voltage value information designated for 23° Celsius, to be combined with the waveform shape information designed for the 20° to 25° Celsius range. This configuration advantageously enables more precise fine-tuning of the waveform shape and voltage levels applied to the display pixels at a particular temperature to achieve superior display performance over conventional solutions without a significant increase in cost of the EPD module.

In some embodiments, the Tcon may be further configured to calculate the DC balance pulse needed to maintain a DC balance based on the applied waveforms. Referring again to FIG. 5, the waveform 500 may include a DC balance pulse portion 504 configured to keep the waveform 500 DC balanced overall. In operation, applying the temperature-specific waveform shapes and voltage levels provided by LUTs may not maintain an overall DC balance. However, the Tcon can maintain a DC balance by either calculating the required DC balance pulse in real time, or retrieving DC balance pulse information that has been pre-determined and stored within the display controller circuitry.

Figure 6:
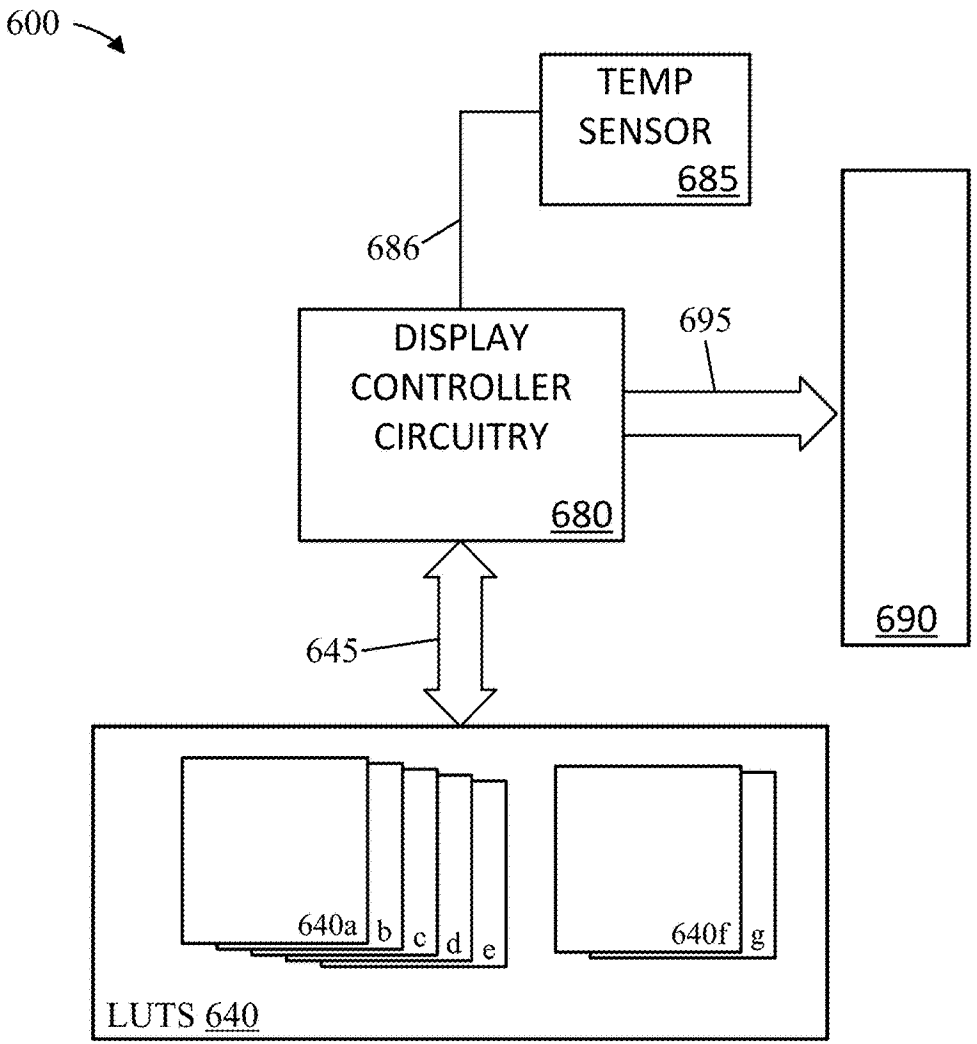
FIG. 6 is a block diagram of an exemplary electrophoretic display in accordance with the subject matter described herein.

FIG. 6 is a block diagram of an electrophoretic display 600 in accordance with the subject matter described herein. Electrophoretic display 600 includes many of the same elements as electrophoretic display 400 of FIG. 4, but LUTs 640 of electrophoretic display 600 are configured to separate waveform shape information from voltage level information.

It has been observed that having greater precision with regard to the voltage level applied to a display pixel at a particular temperature has a more beneficial effect than having greater precision with regard to the shape of the waveforms that are applied. Accordingly, in the exemplary configuration shown in FIG. 6, LUTs 640*a*-640*e* store information describing waveforms for use over a temperature range of 0° to 50° Celsius. For example, LUT 640*a* can include waveform shape information optimized for driving display pixels when the measured temperature is in the range of 0° to 9° Celsius. Similarly, LUT 640*b* can include waveform shape information optimized for driving display pixels when the measured temperature is in the range of 10° to 19° Celsius, and so on, with LUT 640*e* including waveform shape information optimized for driving display pixels when the measured temperature is in the range of 40° to 50° Celsius.

Further, in the exemplary configuration shown in FIG. 6, LUTs 640*f* and 640*g* store information describing voltage level information for use over a temperature range of 0° to 50° Celsius. For example, LUT 640*f* can include voltage level information optimized for driving display pixels when the measured temperature is in the range of 0° to 24° Celsius, with a granularity of one set of voltage level information per one degree of temperature. Similarly, LUT 640*g* can include voltage level information optimized for driving display pixels when the measured temperature is in the range of 25° to 50° Celsius, also with a granularity of one set of voltage level information per one degree of temperature.

Accordingly, the configuration of electrophoretic display 600 requires less memory for LUTs, as only a total of seven LUTs are used (five LUTs for storing waveform shape information and two LUTs for storing voltage level information). This configuration advantageously reduces the overall cost of an EPD module while still providing improved stability and performance of the EPD across a wide temperature range.

It will be apparent to those skilled in the art that numerous changes and modifications can be made to the specific embodiments of the invention described above without departing from the scope of the invention. Accordingly, the whole of the foregoing description is to be interpreted in an illustrative and not in a limitative sense.

The invention claimed is:

1. An electro-optic display comprising:

a display stack comprising a layer of electro-optic material disposed between a common electrode and an array of pixel electrodes, wherein each pixel electrode is associated with a display pixel;

a display controller circuit in electrical communication with the display stack, the display controller circuit capable of applying waveforms to each display pixel by applying one or more time-dependent voltages between the common electrode and each pixel electrode of the array of pixel electrodes;

a temperature sensor in communication with the display controller circuit, wherein the temperature sensor is positioned proximate to the display stack;

a first plurality of look-up tables in communication with the display controller circuit, the first plurality of look-up tables comprising waveform shape data representing a plurality of shapes of waveforms the display controller circuit is capable of applying to each display pixel to transition an initial optical state of each display pixel to a final optical state; and a second plurality of look-up tables in communication with the display controller circuit, the second plurality of look-up tables comprising voltage amplitude data representing a plurality of voltage amplitudes the display controller circuit is capable of applying to each display pixel to transition the initial optical state of each display pixel to the final optical state.

2. The electro-optic display of claim 1 wherein each look-up table of the first plurality of look-up tables corresponds to one range of a first plurality of temperature ranges.

3. The electro-optic display of claim 2 wherein each range of the first plurality of temperature ranges is a subset of an operating temperature range of the electro-optic display.

4. The electro-optic display of claim 2 wherein each look-up table of the second plurality of look-up tables corresponds to one range of a second plurality of temperature ranges.

5. The electro-optic display of claim 4 wherein each range of the second plurality of temperature ranges is a subset of an operating temperature range of the electro-optic display.

6. The electro-optic display of claim 4 wherein the display controller circuit is configured to:

receive a temperature signal representing a temperature measured proximate to the display stack;

select waveform shape data from a look-up table of the first plurality of look-up tables based on the temperature measured proximate to the display stack;

select voltage amplitude data from a look-up table of the second plurality of look-up tables based on the temperature measured proximate to the display stack; and apply waveforms to each display pixel based on the selected waveform shape data and voltage amplitude data.

7. The electro-optic display of claim 6 wherein the temperature measured proximate to the display stack is within a range of the first plurality of temperature ranges, and the look-up table of the first plurality of look-up tables corresponds to the range of the first plurality of temperature ranges.

8. The electro-optic display of claim 6 wherein the temperature measured proximate to the display stack is within a range of the second plurality of temperature ranges, and the look-up table of the second plurality of look-up tables corresponds to the range of the second plurality of temperature ranges.

9. The electro-optic display of claim 1 wherein the voltage amplitude data comprises voltage amplitude data representing at least four voltage amplitudes the display controller circuit is capable of applying to each display pixel to transition the initial optical state of each display pixel to the final optical state.

10. The electro-optic display of claim 4 wherein each range of the first plurality of temperature ranges is wider than each range of the second plurality of temperature ranges.

11. A method for driving an electro-optic display, the method comprising:

providing a display stack comprising a layer of electro-optic material disposed between a common electrode and an array of pixel electrodes, wherein each pixel electrode is associated with a display pixel;

providing a display controller circuit in electrical communication with the display stack, the display controller circuit capable of applying waveforms to each display pixel by applying one or more time-dependent voltages between the common electrode and each pixel electrode of the array of pixel electrodes;

providing a temperature sensor in communication with the display controller circuit, wherein the temperature sensor is positioned proximate to the display stack;

providing a first plurality of look-up tables in communication with the display controller circuit, the first plurality of look-up tables comprising waveform shape data representing a plurality of shapes of waveforms the display controller circuit is capable of applying to each display pixel to transition an initial optical state of each display pixel to a final optical state;

providing a second plurality of look-up tables in communication with the display controller circuit, the second plurality of look-up tables comprising voltage amplitude data representing a plurality of voltage amplitudes the display controller circuit is capable of applying to each display pixel to transition the initial optical state of each display pixel to the final optical state;

receiving a temperature signal representing a temperature measured proximate to the display stack;

selecting waveform shape data from a look-up table of the first plurality of look-up tables based on the temperature measured proximate to the display stack;

selecting voltage amplitude data from a look-up table of the second plurality of look-up tables based on the temperature measured proximate to the display stack; and applying waveforms to each display pixel based on the selected waveform shape data and voltage amplitude data.

12. The method of claim 11 wherein each look-up table of the first plurality of look-up tables corresponds to one range of a first plurality of temperature ranges.

13. The method of claim 12 wherein each range of the first plurality of temperature ranges is a subset of an operating temperature range of the electro-optic display.

14. The method of claim 12 wherein each look-up table of the second plurality of look-up tables corresponds to one range of a second plurality of temperature ranges.

15. The method of claim 14 wherein each range of the second plurality of temperature ranges is a subset of an operating temperature range of the electro-optic display.

16. The method of claim 11 wherein the temperature measured proximate to the display stack is within a range of the first plurality of temperature ranges, and the look-up table of the first plurality of look-up tables corresponds to the range of the first plurality of temperature ranges.

17. The method of claim 11 wherein the temperature measured proximate to the display stack is within a range of the second plurality of temperature ranges, and the look-up table of the second plurality of look-up tables corresponds to the range of the second plurality of temperature ranges.

18. The method of claim 11 wherein the voltage amplitude data comprises voltage amplitude data representing at least four voltage amplitudes the display controller circuit is capable of applying to each display pixel to transition the initial optical state of each display pixel to the final optical state.

19. The method of claim 14 wherein each range of the first plurality of temperature ranges is wider than each range of the second plurality of temperature ranges.

20. The method of claim 11 further comprising determining a DC balance pulse to apply to each display pixel based on the waveforms applied to each display pixel based on the selected waveform shape data and voltage amplitude data.

* * * * *